US006450933B1

(12) United States Patent
Gruenke

(10) Patent No.: US 6,450,933 B1
(45) Date of Patent: Sep. 17, 2002

(54) DECORATIVE FOIL ASSEMBLY

(76) Inventor: B. Gunar Gruenke, W2277 Country Club La., East Troy, WI (US) 43120

( * ) Notice: Subject to any disclaimer, the term of this patent is extended or adjusted under 35 U.S.C. 154(b) by 0 days.

(21) Appl. No.: 09/370,694

(22) Filed: Aug. 9, 1999

(51) Int. Cl.[7] ..... B31B 1/14

(52) U.S. Cl. ..... 493/347; 493/331; 428/4; 428/11

(58) Field of Search ..... 493/331, 957, 493/347, 343; 428/4, 5, 11, 43, 58, 99, 355 RA, 343

(56) References Cited

U.S. PATENT DOCUMENTS

| | | | | | |
|---|---|---|---|---|---|
| 1,475,784 | A | * | 11/1923 | Bentkamp | 428/4 |
| 2,096,352 | A | * | 10/1937 | Semonsen | 428/43 |
| 4,610,899 | A | * | 9/1986 | Miller | 428/4 |
| 4,749,599 | A | | 6/1988 | Rehberg et al. | 428/7 |
| 4,789,571 | A | | 12/1988 | Kinderman et al. | 428/10 |
| 4,806,396 | A | * | 2/1989 | Pratt et al. | 428/4 |
| 4,968,540 | A | * | 11/1990 | Linsenbigler | 428/5 |
| 5,055,326 | A | * | 10/1991 | Whitington | 428/4 |
| 5,079,046 | A | * | 1/1992 | Kessler | 428/4 |
| 5,091,226 | A | | 2/1992 | Protz, Jr. | 428/10 |
| 5,202,169 | A | * | 4/1993 | Spendlove | 428/43 |
| 5,234,725 | A | * | 8/1993 | Smith | 428/4 |
| D354,019 | S | | 1/1995 | Young | D11/119 |
| 5,468,523 | A | * | 11/1995 | Huss et al. | 428/5 |
| 5,500,258 | A | | 3/1996 | Young | 428/10 |
| 5,587,031 | A | | 12/1996 | Young | 156/148 |
| 5,693,381 | A | * | 12/1997 | Cheng | 428/5 |
| RE35,897 | E | | 9/1998 | Protz, Jr. | 493/346 |
| 6,001,209 | A | * | 12/1999 | Popat et al. | 156/249 |
| 6,030,669 | A | * | 2/2000 | Fascio | 428/4 |

* cited by examiner

*Primary Examiner*—John Paradiso
(74) *Attorney, Agent, or Firm*—Andrus, Sceales, Starke & Sawall, LLP

(57) ABSTRACT

A decorative foil assembly for use as a decoration during holidays and other celebrations includes an elongated flat film web of foil-like material which is cut transversely except for a narrow uncut portion on one side of the film web which serves to hold the assembly together after cutting. The resulting decorative assembly includes strips of foil-like material extending downwardly from the narrow uncut portion. The narrow uncut portion of foil-like material includes a double-sided adhesive applied thereto, such as double-sided tape, for removably attaching the decorative foil assembly to a ceiling, wall, window, window frame, or other structure to be decorated. The decorative foil assembly may also include a snowflake having a plurality of foil-like strips extending downwardly from the center of the snowflake.

12 Claims, 3 Drawing Sheets

DECORATIVE FOIL ASSEMBLY

BACKGROUND OF THE INVENTION

The present invention relates to a decorative foil assembly which may be used as a decoration during holidays and other celebrations. The decorative foil assembly may be used to decorate various objects and structures by attaching the assembly to walls, ceilings, windows, window frames, etc.

Holiday decorations including decorative garlands and other tinsel type structures are well known in the art and are made in a variety of ways with different colors and combinations of needle lengths and widths. Many of the materials used to make tinsel and decorative garlands are metallic-coated plastic films which are highly light reflective to enhance the visual sparkle effect of the decorative assembly.

These decorations are typically manufactured from a web of film material that is transversely cut and twisted about a support wire to produce a tinsel-like ornamental string which may be used for decorating various structures such as Christmas trees and the like. Manufacturing methods typically include feeding an elongated film web through a rotary cutter which slices through the film web transversely, except for a narrow uncut portion down the center of the film web which serves to hold the assembly together after cutting.

It is also known to combine individual needles made from separate webs of foil-like material cut that are cut to different widths and lengths and attached to a central support member to create a decorative assembly.

The problem with prior art decorative assemblies is that they are easily hung on Christmas trees and other objects, but are not easily suspended from walls, ceilings, window frames and the like. Therefore, there is a need for a decorative assembly that may be removably and easily attached to walls, ceilings, windows, window frames and other structures to decorate same during the holidays.

The decorative assembly of the present invention is easily attached to walls, ceilings, windows, window frames and the like due to a double-sided adhesive applied to the assembly.

SUMMARY OF THE INVENTION

The present invention provides a decorative foil assembly for use as a decoration during holidays and other celebrations. The decorative foil assembly is preferably made from an elongated flat film web of foil-like material which is fed through a rotary cutter which slices through the film web transversely, except for a narrow uncut portion on one side of the web which serves to hold the assembly together after cutting. Alternatively, the elongated flat film web of foil-like material may be cut with a laser which is programmed to cut the web transversely in any configuration, except for a narrow uncut portion on one side of the web which serves to hold the assembly together after cutting. The resulting decorative assembly includes foil-like strips extending downwardly from the narrow uncut portion to be used as a decorative assembly. The elongated flat film web is preferably comprised of a single sheet of foil-like material, but may also be comprised of a plurality of sheets.

The narrow uncut portion of the web includes a double-sided adhesive applied thereto, such as double-sided tape, for removably attaching the decorative foil assembly to a ceiling, wall, window, window frame or other structure to be decorated. The invention also contemplates a narrow uncut portion on both sides of the web which are folded over and attached to each other to create strips having looped-ends. In addition, the web may comprise at least two uncut portions located between the narrow uncut portions on each side of the web.

The decorative foil assembly is preferably removably attached to a surface or structure in a horizontal manner, but may also be attached vertically to produce a different visual effect. The decorative foil assembly can be suspended in such a manner that the foil-like strips hang downwardly from the uncut portion to achieve the appearance of tinsel or other similar decorative strips.

The method of making the decorative foil assembly involves feeding the web through a rotary cutter which slices through the web, except for a narrow uncut portion on one side of the web which serves to hold the assembly together after cutting, and serves to affix the assembly to a structure. The web may also be cut by a laser to yield the same or different results. The resulting structure of the decorative foil assembly includes a plurality of foil-like strips extending downwardly from a narrow uncut portion on one side of the web. The narrow uncut portion having an adhesive applied thereto for attaching the decorative foil assembly to an object or structure.

In addition, the present invention contemplates a decorative foil assembly which includes a snowflake made from a foil-like material and having a plurality of foil-like strips extending downwardly from the center of the snowflake. The snowflake includes a double-sided adhesive applied thereto for attachment of the snowflake to a surface or structure.

Various other features, objects, and advantages of the invention will be made apparent from the following detailed description and the drawings.

BRIEF DESCRIPTION OF THE DRAWINGS

The drawings illustrate the best mode presently contemplated of carrying out the invention. In the drawings.

DETAILED DESCRIPTION OF THE INVENTION

Figure 1A:
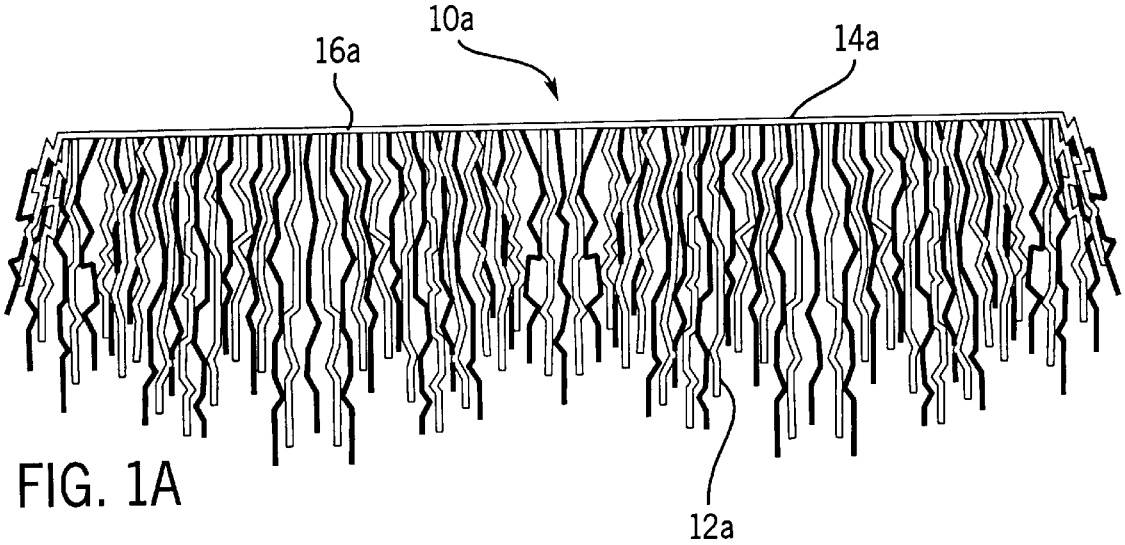
FIG. 1A is an isometric side view of a decorative foil assembly constructed in accordance with the present invention.

FIGS. 1A–1D all illustrate different forms of decorative foil assemblies which may be produced in accordance with the present invention. In particular, FIG. 1A shows a decorative foil assembly 10*a* which includes a plurality of foil-like strips 12*a* hanging downwardly from a narrow uncut portion 14*a*. The decorative foil assembly 10*a* is preferably made from an elongated flat film web of foil-like material. The web may contain a single sheet of foil-like material or a plurality of sheets. The web is cut transversely along one side of the web to create the strips 12*a* and the narrow uncut portion 14*a*. The strips 12*a* are cut in a variety of lengths and widths which hang downwardly from the narrow uncut portion 14*a*. The decorative foil assembly 10*a* is preferably created by feeding the elongated flat film web of foil-like material through a rotary cutter or a laser assembly which slices through the film web transversely, except for a narrow uncut portion on one side of the web which serves to hold the assembly together after cutting. The invention also contemplates a narrow uncut portion on each side of the web which are folded over and attached to each other to create strips having looped-ends. In addition, the web may comprise at least two uncut portions located between the narrow uncut portions on each side of the web.

Figure 1B:
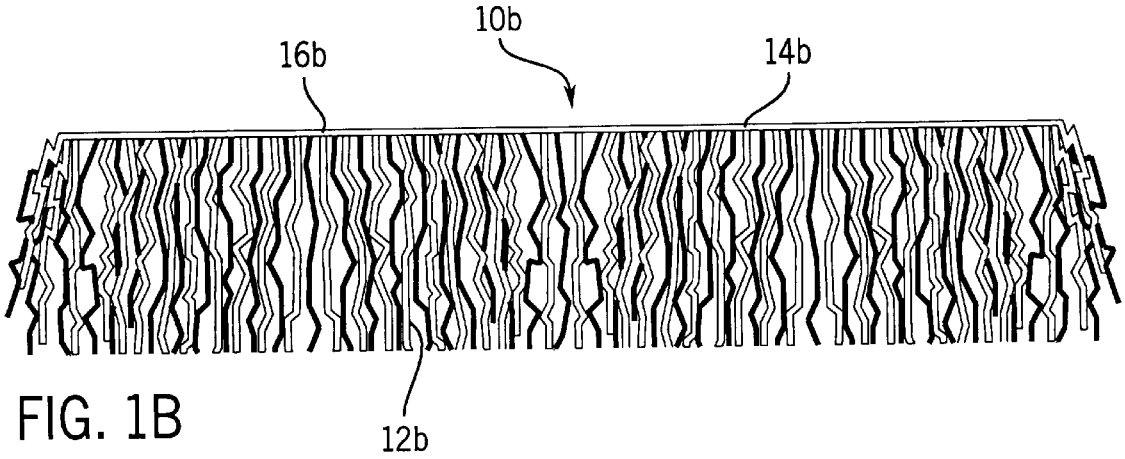
FIG. 1B is an isometric side view of a decorative foil assembly similar to FIG. 1A except that the tinsel is substantially the same length.
Figure 1C:
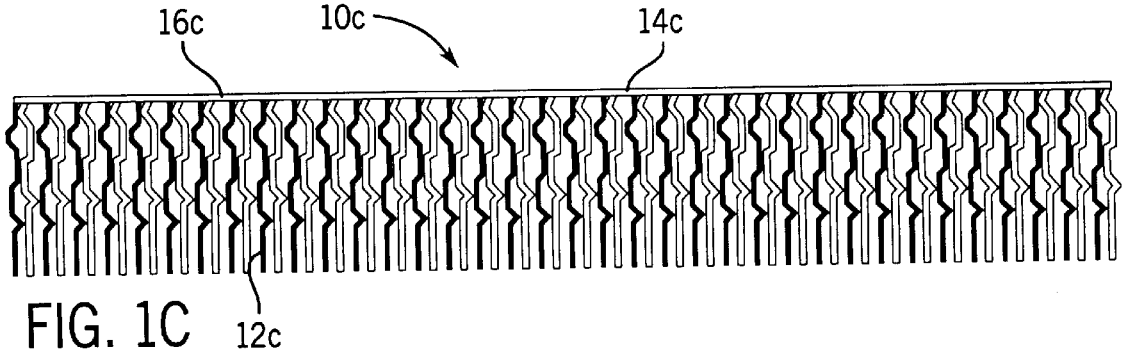
FIG. 1C is an isometric side view of another decorative foil assembly similar to FIGS. 1A and 1B which may be cut by a precision laser.
Figure 1D:
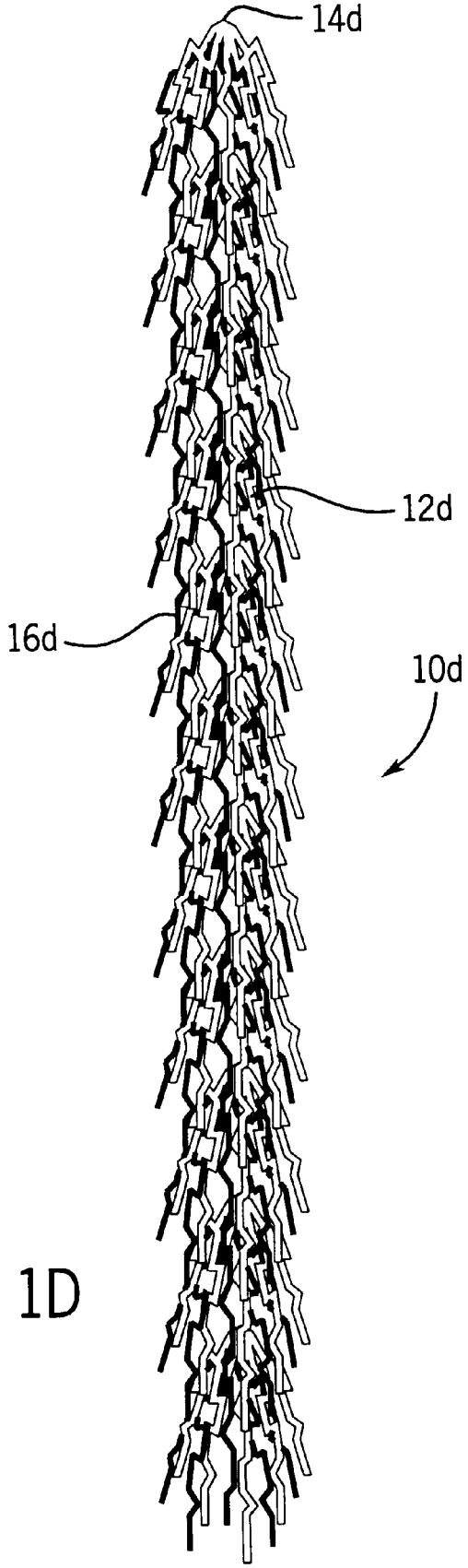
FIG. 1D is an isometric view of a decorative foil assembly hung in a vertical orientation rather than the horizontal orientations of FIGS. 1A, 1B and 1C.

The narrow uncut portion 14*a* includes a double-sided adhesive 16*a* applied thereto, such as double-sided tape, for removably attaching the decorative foil assembly 10*a* to a wall, ceiling, window, window frame or other structure or surface to be decorated. The decorative foil assembly 10*a* is preferably removably attached to a surface or structure in a horizontal manner as shown in FIGS. 1A, 1B and 1C, but may also be attached vertically to produce a different visual effect as shown in FIG. 1D. The decorative foil assembly 10*a* is suspended in such a manner by removably attaching the narrow uncut portion 14*a* having a double-sided adhesive 16*a* applied thereto that the foil-like strips 12*a* hang downwardly from the uncut portion 14*a* to achieve the appearance of tinsel or other similar decorative assembly.

FIG. 1B illustrates a decorative foil assembly 10*b* similar to that shown in FIG. 1A except that the plurality of foil-like strips 12*b* hanging downwardly from a narrow uncut portion 14*b* are all substantially the same length. The decorative foil assembly 10*b* shown in FIG. 1B is specifically cut so that the foil-like strips 12*b* are all substantially the same length.

The narrow uncut portion 14*b* includes a double-sided adhesive 16*b* applied thereto, such as double-sided tape, for removably attaching the decorative foil assembly 10*b* to a wall, ceiling, window, window frame or other structure to be decorated.

FIG. 1C illustrates a decorative foil assembly 10*c* similar to that shown in FIGS. 1A and 1B. The decorative foil assembly 10*c* is preferably made from a elongated flat film web of foil-like material which is cut along one side thereof, except for a narrow uncut portion on the other side of the web which serves to hold the assembly together after cutting. The resulting decorative assembly 10*c* includes a plurality of foil-like strips 12*c* extending downwardly from the narrow uncut portion 14*c*. The narrow uncut portion 14*c* includes a double-sided adhesive 16*c* applied thereto, such as double-sided tape, for removably attaching the decorative foil assembly to surfaces of structures to be decorated.

FIG. 1D illustrates a decorative foil assembly 10*d* similar to the decorative foil assemblies shown in FIGS. 1A and 1B. The only difference between these decorative foil assemblies is that the decorative foil assembly 10*d* is orientated vertically while the other decorative assemblies 10*a*, 10*b* are orientated horizontally. In FIGS. 1A, 1B, 1C, the plurality of foil-like strips 12*a*, 12*b*, 12*c* extend downwardly and substantially perpendicular from the uncut portion 14*a*, 14*b*, 14*c*. In FIG. 1D, the plurality of foil-like strips 12*d* extend downwardly and substantially parallel from the uncut portion 14*a*, 14*b*, 14*c*. The decorative foil assembly 10*d* is preferably made from an elongated flat film web of foil-like material which is cut transversely on one side thereof, except for a narrow uncut portion 14*d* on the other side of the web which serves to hold the assembly together after cutting. The resulting decorative assembly 10*d* includes a plurality of foil-like strips 12*d* extending downwardly from the narrow uncut portion 14*d*. The narrow uncut portion 14*d* includes a double-side adhesive 16*d* applied thereto, such as double-sided tape for removably attaching the decorative foil assembly 10*d* in a vertical orientation to a wall, ceiling, window, window frame or other structure to be decorated.

Figure 2:
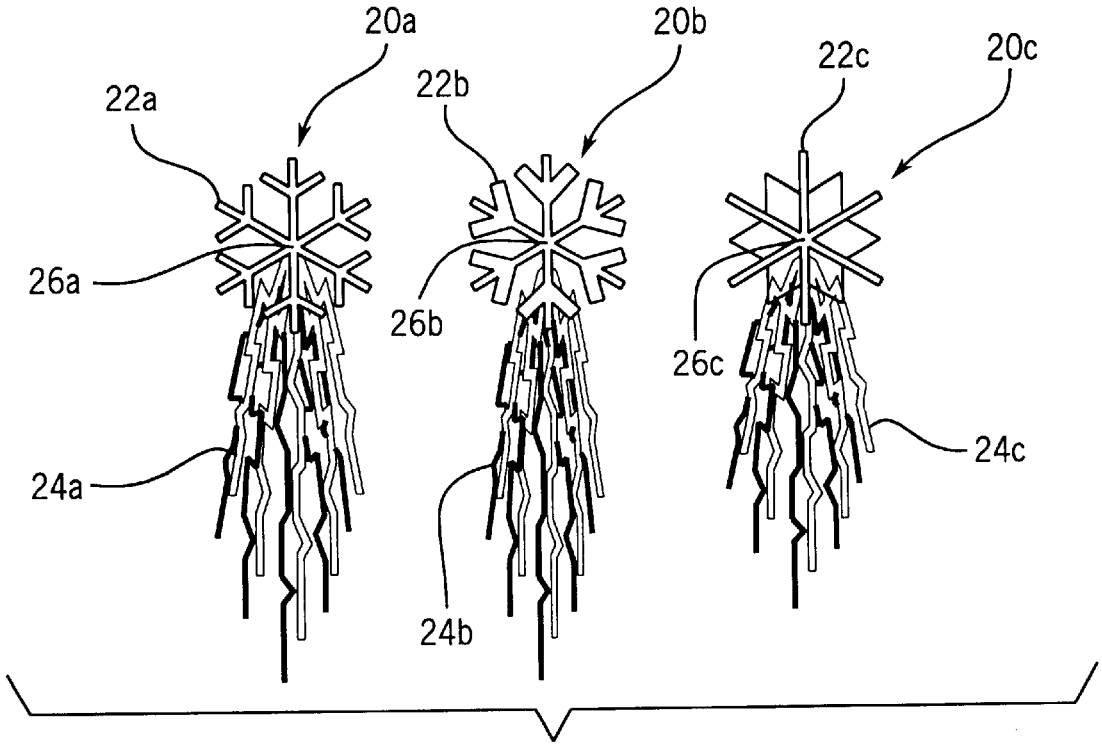
FIG. 2 is an isometric view of a decorative foil assembly comprising snowflake with decorative strips hanging downwardly from the snowflakes.

FIG. 2. illustrates three different decorative foil assemblies 20*a*, 20*b* and 20*c* wherein the decorative foil assemblies include a snowflake 22*a*, 22*b*, 22*c* having a plurality of foil-like strips 24*a*, 24*b*, 24*c* extending downwardly from the center of each snowflake. Double-sided adhesive 26*a*, 26*b*, 26*c* is applied to one side of each snowflake 22*a*, 22*b*, 22*c* for removably attaching the decorative assemblies 20*a*, 20*b*, 20*c* to a structure or surface to be decorated. The snowflakes are preferably made from a flat film web of foil-like material which is cut into a snowflake shape with a plurality of strips extending downwardly from the snowflake. FIG. 2 illustrates three different types of snowflakes which may be used in accordance with the present invention. These snowflakes are not exhaustive of the types of snowflakes or other designs which may be contemplated by the present invention.

It is recognized that other equivalents, alternatives, and modifications aside from those expressly stated, are possible and within the scope of the appended claims.

What is claimed is:

1. A one piece decorative foil assembly comprising:

an elongated flat film web of a thin metallic material having first and second edges and being cut transversely on one of said edges thereof with said cuts extending substantially across said web and defining narrow uncut portion on the other of said edges of the web which serves to hold the assembly together after cutting, the transversely cut portion creating a plurality of strips depending from and integral with the uncut portion of the web, the uncut portion including adhesive applied thereto for removably attaching the decorative foil assembly.

2. The decorative foil assembly of claim 1 wherein the plurality of thin metallic strips extend downwardly from the uncut portion of the web.

3. The decorative foil assembly of claim 2 wherein the plurality of thin metallic strips extending downwardly from the uncut portion are of various lengths, widths, and shapes.

4. The decorative foil assembly of claim 2 wherein the plurality of thin metallic strips extending downwardly from the uncut portion are of substantially the same length and width.

5. The decorative foil assembly of claim 1 wherein the adhesive is double-sided tape.

6. The decorative foil assembly of claim 1 wherein the narrow uncut portion is removably attached to the structure in a horizontal orientation with the plurality of thin metallic strips extending downwardly and substantially perpendicular to the uncut portion.

7. The decorative foil assembly of claim 1 wherein the narrow uncut portion is removably attached to the structure in a vertical orientation with the plurality of thin metallic strips extending downwardly and substantially parallel to the uncut portion.

8. The decorative foil assembly of claim 1 wherein the elongated flat film web of thin metallic material includes a plurality of sheets attached together along the narrow uncut portion.

9. A one piece decorative foil assembly comprising:

an elongated flat film web of a thin metallic material having first and second edges and first and second ends with one of said ends being cut into a snowflake shape a plurality of thin metallic strips extending downwardly from the center of said snowflake, one side of said snowflake including adhesive applied thereto for removably attaching the decorative foil assembly to a structure to be decorated.

10. The decorative foil assembly of claim 9 wherein the plurality of thin metallic strips are of different lengths.

11. The decorative foil assembly of claim 9 wherein the plurality of thin metallic strips are substantially the same length.

12. The decorative foil assembly of claim 9 wherein the adhesive is double-sided tape.

* * * * *